United States Patent [19]

Mattox

[11] 4,249,725

[45] Feb. 10, 1981

[54] EXERCISE APPARATUS

[76] Inventor: Ernest M. Mattox, 18509 E. 6th St. No., Independence, Mo. 64056

[21] Appl. No.: 7,510

[22] Filed: Jan. 29, 1979

[51] Int. Cl.[3] ..... A63B 21/06; A63B 21/20; A63B 21/22

[52] U.S. Cl. ..... 272/117; 272/125; 272/128; 272/130

[58] Field of Search ..... 272/125, 128, 130, 134, 272/116, 117

[56] References Cited

U.S. PATENT DOCUMENTS

| | | | |
|---|---|---|---|
| 1,279,633 | 9/1918 | Allen | 272/116 |
| 3,731,922 | 5/1973 | Jungreis | 272/117 |

FOREIGN PATENT DOCUMENTS

| | | | |
|---|---|---|---|
| 779363 | 1/1935 | France | 272/73 |

*Primary Examiner*—George J. Marlo
*Attorney, Agent, or Firm*—Schmidt, Johnson, Hovey & Williams

[57] ABSTRACT

In order to be resisted by a force of given magnitude from the apparatus, the user must accelerate through the exercising stroke he makes on the machine. A rotor within the machine is spun when the user moves the operating lever through its stroke, and the inertia of the spinning rotor forces the user to constantly accelerate during the exercising stroke if the user is to obtain resistance that will match his input efforts. Weighted drag paddles on the rotor retard spinning thereof as a result of their weight and interaction with a fluid medium during such spinning and consequently provide a source of resistance to the user's effort to spin the rotor, the fluid medium preferably being ambient air. The magnitude of the resistance generated by the rotor at any given speed of rotation thereof can be adjustably increased or decreased prior to the exercising stroke by changing the radial position of the paddles. The paddles are mounted on carriages which may be shifted selectively along radial tracks by an external adjusting knob coupled with a tubular shaft that, when adjustably rotated relative to the internally received main shaft of the rotor, drives a chain connected to the carriages.

14 Claims, 6 Drawing Figures

EXERCISE APPARATUS

TECHNICAL FIELD

This invention relates to the field of so-called "isokinetic" exercising; more particularly, it relates to an advancement from the standard principles of isokinetics to a higher, more beneficial level that may be referred to as "accelerating isokinetics".

BACKGROUND ART

Presently available isokinetic equipment operates on the principle of so-called "accommodating resistance"; that is, the effort expended by the user in moving an operating lever or the like will be matched by the equipment throughout the full range of muscular contraction of the user. Consequently, even though changes in the locations of pivot points, the lengths of lever arms, etc. will vary in the user's arms and legs as he moves the operating lever through an exercising stroke so as to enable the user to obtain better leverage against the resistive force supplied by the equipment, nonetheless the isokinetic equipment "accommodates" the changing conditions and at all times matches the effort being expended by the user, thus assuring that the user's muscles are taxed throughout the full range of their contracting movement.

These prior devices have by and large utilized a pair of relatively rotatable members whose frictional interengagement during such rotation creates the resistance needed to match the user's input efforts, and as long as the user moves the operating lever or handle at the same speed throughout the exercising stroke, the resistance furnished by the machine would remain the same.

SUMMARY OF THE PRESENT INVENTION

It has now been established that for optimum results insofar as muscular development is concerned, it is highly desirable for the individual to move through an accelerating exercising stroke rather than one of constant velocity throughout. Consequently, an important object of the present invention is to provide apparatus which, while continuing with the fundamental isokinetic concept of "accommodating resistance" so as to always match the effort being exerted by the user, goes beyond such fundamental concepts by forcing the user to accelerate through his exercising stroke in order to obtain a matching resistance from the apparatus.

Pursuant to this objective, the present invention incorporates a rotor which is spun by the user during the exercise stroke. The rotor incorporates weight means and air drag means positioned radially outwardly from the axis of rotation of the rotor. Thus, the weight means tends to keep the rotor spinning once the user has started shifting the operating lever of the machine; hence, in order for the user to encounter matching resistance to his input efforts, he must continually accelerate through the exercising stroke and spin the rotor ever more rapidly. By the same token, however, the air drag means of the rotor tempers the momentum of the rotor and retards its spinning so that unduly rapid acceleration is not required by the user.

The rotor preferably utilizes both air drag means and weight means, although each has its own attributes independently of the other and may therefore be utilized by itself in a rotor.

The drag-creating means and/or the weight means may be adjusted prior to use so as to change their radially inwardly or outwardly disposed location on the rotor, thereby altering the resistance generated by the rotor at any given speed of exercising stroke.

Alternatively, without changing the position of the drag means or the weight means, a speed control may be utilized in the drive train to the rotor so as to change the speed at which the rotor spins at any given speed of exercising stroke.

DETAILED DESCRIPTION

Figure 1:
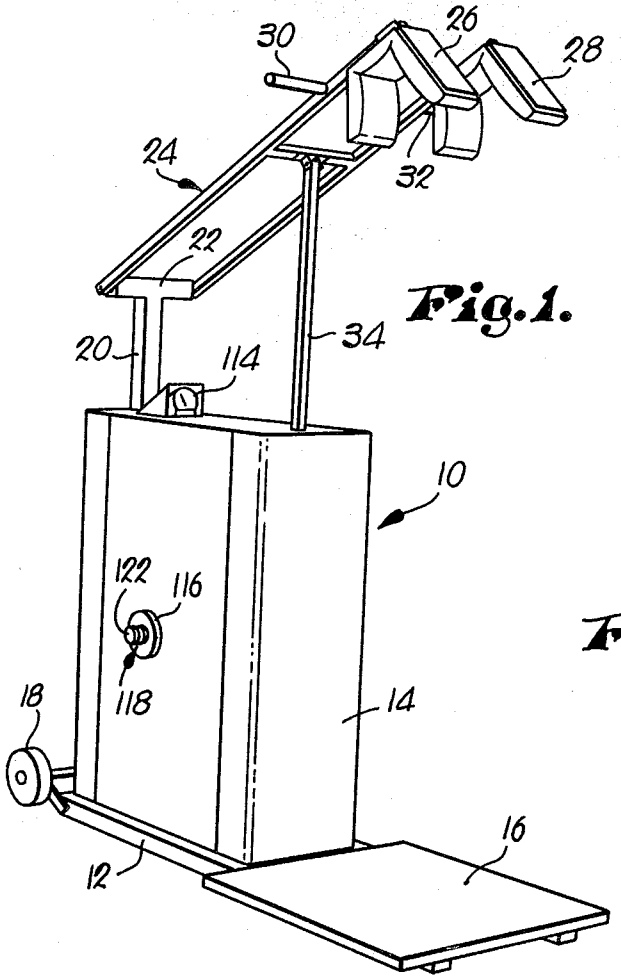
FIG. 1 is a front, left perspective view of one type of excerising machine which might incorporate apparatus constructed in accordance with the principles of the present invention.

The machine 10 of FIG. 1 is but one example of the type of machine within which the apparatus according to the present invention may be utilized. It so happens that the particular machine 10 herein selected for purposes of illustration includes a chassis 12, an upstanding, boxlike housing 14 rising from the chassis 12, a platform 16 attached to the chassis 12 and located in front of the housing 14 at the bottom of the latter, and one or more wheels 18 at the rear of chassis 12 which may be used to facilitate movement of the machine 10 from one location to another.

The machine 10 further includes a riser 20 projecting upwardly from the chassis 12 at the rear of the housing 14 and through the latter, such riser 20 terminating at its uppermost end in a cross bar 22. An open framework type lever 24 is pivoted at one end to the cross bar 22 for vertical swinging movement about a horizontal axis, the opposite end of the lever 24 being provided with a pair of shoulder pads 26 and 28 for receiving opposite ones of the user's shoulders, and being further provided with a pair of handles 30 and 32 adjacent opposite ones of the pads 26,28 by which the user can grasp the lever 24 as he raises the latter during movement from a squatting position to a fully extended, upright position.

A plunger rod 34 is pivotally connected to the lever 24 between the front and rear ends thereof and extends downwardly into the housing 14 through an opening 36 in the top wall 38 of the housing 14. An upstanding guide 40 rising from the chassis 12 is telescopically received by the tubular plunger rod 34 so as to guide the plunger rod 34 during vertical reciprocation thereof and, although not shown, it is to be understood that a suitable spring or the like may be received within the tubular plunger rod 34 in such a way as to bear against the guide 40 during descent of the lever 24 to break the fall of the latter.

One end 42 of a chain 44 is anchored to the lower end of the plunger rod 34, and from that location the chain 44 passes upwardly to be entrained around an idler sprocket 46, thence downwardly for entrainment around a driven sprocket 48 adjacent the bottom of the housing 14, and thence upwardly where the opposite end 50 of the chain 44 is anchored to the lower end of the plunger rod 34. Driven sprocket 48 is in turn fixed to a jack shaft 52 rotatably supported by bearings (not shown) in opposite, generally triangular shaped uprights 54 and 56, the driven sprocket 48 being located substantially midway between the two uprights 54 and 56. The jack shaft 52 also carries a larger sprocket 58 inwardly adjacent the upright 56, and such sprocket 58 is entrained by a generally fore-and-aft extending endless drive chain 60 looped also around a smaller sprocket 62 adjacent the rear of the uprights 54,56. The sprocket 62 is in turn secured to a transversely extending jack shaft 64 journaled by bearings 66 and 68 on the uprights 54 and 56 respectively.

The jack shaft 64 extends outwardly through the bearing 68 and beyond the upright 56, at which location it carries a sprocket 70. The sprocket 70 is in turn entrained by a generally vertically extending endless drive chain 72 looped around a special sprocket 74 at the upper end of the element 72. The special sprocket 74 is in turn associated with a one-way clutch 76 (FIG. 4) which receives a horizontally extending shaft 78 and drivingly connects the sprocket 74 with the shaft 78 in one direction of rotation only of the sprocket 74. A collar 80 retains the sprocket 74 and the clutch 76 on the shaft 78.

The shaft 78 is journaled adjacent one end thereof by a bearing 82 at the upper end of the upright 56. Near the center of the shaft 78, the latter is welded to a rotor 84 as illustrated best in FIG. 4 such that the rotor 84 is adapted for rotation with the shaft 78 about the longitudinal axis of the latter. Rotor 84 includes a pair of radially oppositely extending, formed metal arms 86 which taper toward a reduced dimension as their radially outermost tips are approached. Each of the arms 86 is longitudinally slotted along the normally leading portion thereof so as to define a track 88 leading in a generally radially extending direction with respect to the axis of rotation of the rotor 84. Each track 88 receives a corresponding carriage block 90 that is reciprocable therein toward and away from the axis of rotation of the rotor 84, and each of the carriage blocks 90 is rigidly attached to a broad, flat plate or paddle 92 having a planar face disposed transversely of the plane of rotation of the rotor 84. The paddles 92, by virtue of their relatively broad surface area, function as means for creating a drag through the air as the rotor 84 is rotated during use. At the same time, the paddles 94 represent a considerable amount of weight, the location of which with respect to the axis of rotation of the rotor 84 has a definite bearing upon the ease with which the rotor 84 can indeed be rotated.

The tracks 88 and the carriage blocks 90 represent part of what may be broadly termed mechanism 94 by virtue of which the radial location of the paddles 92 can be adjusted. A further component of such mechanism 94 includes an essentially endless element 96 (which may in fact comprise a pair of elements arranged substantially end to end if such is necessary or desirable) looped around respective guide members 98 at the outer ends of the arms 86. The element 96 is also secured to respective ones of the carriage bars 90 via fasteners 100 such that, upon driving the element 96 linearly of itself, the paddles 92 are caused to shift inwardly or outwardly along their tracks 88 depending upon the direction of driving movement of the element 96.

Figure 4:
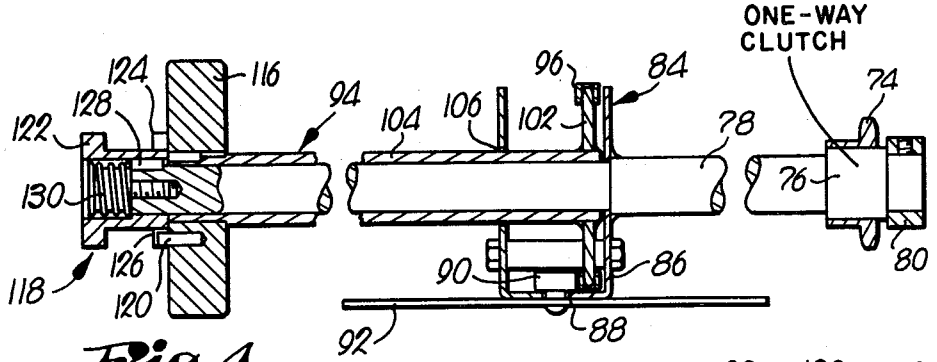
FIG. 4 is a still further enlarged, fragmentary, detail view of the apparatus illustrating in particular the nature of the control for adjusting the position of the drag and/or weight means associated with the rotor.
Figure 3:
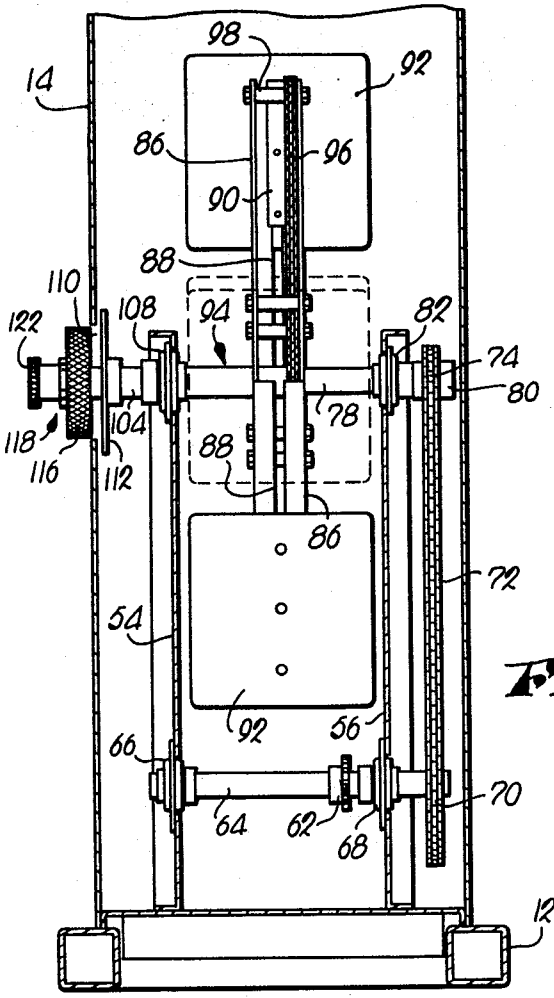
FIG. 3 is a further enlarged, fragmentary, vertical, cross-sectional view through the machine taken substantially along line 3—3 of FIG. 2.

The element 96 entrains a drive sprocket member 102 as another part of the mechanism 94, such member 102 being rigidly affixed to the inner end of a tube 104 receiving the shaft 78. As illustrated in FIG. 4, the innermost end of the tube 104 terminates slightly inboard of a proximal wall of the arms 86, and from that point projects through an opening 106 in the opposite wall of the arms 86. Tube 104 continues beyond the opening 106 where it is journaled by a bearing 108 supported by the upper end of the upright 54 in coaxial alignment with the bearing 82 of the opposite upright 56. As illustrated in FIG. 3, the tube 104 coninues outwardly beyond the bearing 108 through an enlarged hole 110 in the housing 14. Parenthetically, it should be noted that if desired, a speedometer can be utilized in connection with the present invention, in which event the usual disc 112 may be attached to the tube 104 adjacent the hole 110, the disc 112 in turn being operably connected through a cable not shown to a display 114 on top of the housing 14.

As illustrated in most detail in FIG. 4, the mechanism 94 further includes a knob 116 keyed to the tube 104 adjacent the outer end of the latter beyond the hole 110 in the housing 14. Still further, the mechanism 94 includes an assembly 118 for releasably holding the tube 104 against rotation relative to the shaft 78, such relative rotation causing rotation of the sprocket 102 relative to the shaft 78 and in turn adjusting the positions of the paddles 92 along the tracks 88. Functionally speaking, the assembly 118, the knob 116, the tube 104, the sprocket 102, and the element 96 may be considered a control for the carriages 90.

The assembly 118 includes a pin 120 projecting a short distance outwardly beyond the outer face of the knob 116 as shown in FIG. 4. Further, the assembly 118 includes a cap 122 provided with an annular lip 124 normally abutting against the outer flat face of the knob 116, said lip 124 being perforated at circumferentially spaced locations for reception of the pin 120 in a selected one of such perforations 126, for example, the perforation 126 in FIG. 4. As long as the pin 120 is received within one of the perforations 126, the cap 122 locks the shaft 78 and tube 104 against relative rotation. However, the cap 122 is attached to the shaft 78 via a suitable key-and-slot means 128 such that, although the cap 122 rotates with the shaft 78, it may be manually grasped and pulled outwardly for a short distance to the extent permitted by the key-and-slot means 128. When the cap 122 is indeed pulled outwardly to the extent permitted by the key-and-slot means 128, the perforations 126 clear the pin 120, permitting the knob 116 to be rotated relative to the cap 122 until another selected perforation 126 is in registration with the pin 120. A spring unit 130 within a recess of the cap 122 yieldably biases the latter inwardly toward the knob 116 and thus towrd a locked condition of the pin 120 within one of the perforations 126.

Operation

The operation of the invention as hereinabove set forth should be apparent at this point; however, it will be briefly set forth now as follows.

Figure 2:
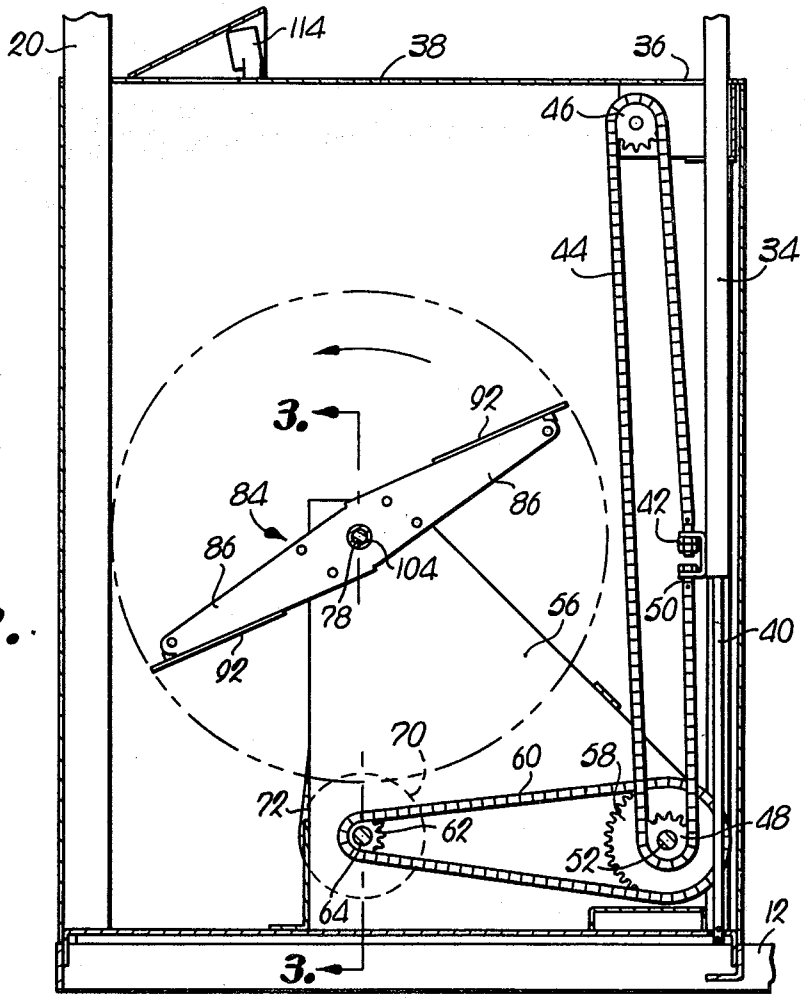
FIG. 2 is an enlarged, fragmentary, longitudinal, vertical, cross-sectional view through the machine of FIG. 1 illustrating said apparatus.

As the user pushes upwardly through his shoulders to lift the lever 24, the plunger rod 34 is likewise raised to in turn drive the chain 44 which untimately drives the sprocket 74 in a corresponding direction. Through the one-way clutch 76 (which incidentally may be any one of a number of commercially available one-way clutches such as those sold by the Torrington Bearing Company of Torrington, Connecticut and designated "drawn cup roller clutch"), the shaft 78 is likewise caused to rotate. This forces the rotor 84 to spin with the shaft 78 about the longitudinal axis of the latter, such spinning of the rotor 84 being in a counterclockwise direction as viewed in FIG. 2 such that the paddles 92 create an air drag and thereby resist such spinning. Such drag is transmitted back through the drive train for the rotor 84 such that the user encounters resistance to his efforts to upwardly thrust the lever 24.

Because each of the paddles 92 has a certain amount of weight associated therewith, such weight likewise provides a resistance to rotation of the rotor 84, which resistance is also transmitted back through the driving means for the rotor 84 which must be overcome by the user. On the other hand, because of such weight, the rotor 84 has a tendency to keep spinning once the user has started raising lever 24 and, therefore, the user must accelerate the lever 24 and spin the rotor at an increasingly faster rate during the stroke in order for this capacity to exert force to be matched by the rotor 84. The air drag created by the paddles 92 keeps the rotor 84 from spinning too freely, but at the same time, since the air can escape from the surfaces of the paddles 92, and because air is compressible, the drag is not excessive.

As the user then returns back toward a squatting position, the lever 24 descends by gravity or is pulled downwardly by the user as he grasps the handles 30 and 32. During such retrograte movement, however, the rotor 84 may continue to spin by virtue of the overrunning nature of the clutch 76 as the sprocket 74, the chain 72, the sprocket 70, the jack shaft 64, the sprocket 62, the chains 60, the sprocket 58, the jack shaft 52, the sprocket 48 and the chain 44 are reversely operated. Thereupon, after the return stroke has been completed, the user may once again push upwardly on the lever 24 through the shoulder pads 26,28 to place the rotor driving means in the forward mode and cause the sprocket 74 to drivingly engage the shaft 78 through the clutch 76. Once again, the resistance created by the paddles 92 is transmitted to the user such as to appropriately tax his muscles over their full range of contraction.

Figure 5:
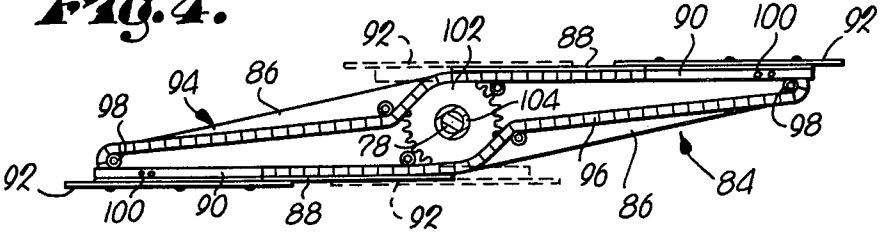
FIG. 5 is a transverse, cross-sectional view through the rotor of the apparatus illustrating further details of the position control for the drag and weight means, the phantom lines indicating the radially innermost positions of the drag means and the weight means.

The magnitude of resistance created by the rotor 84 for any given speed of exercising stroke in which the lever 24 is raised may be adjusted through the mechanism 94 as earlier described. When the cap 122 is pulled outwardly sufficiently far to disengage the perforation 126 from the pin 120, the knob 116 may be manually rotated to in turn rotate the tube 104 about the shaft 78. This in turn rotates the sprocket 102 relative to the shaft 78 such that the element 96 is driven to operate the carriages 90 within their slot tracks 88 and thereby shift the paddles 92 inwardly or outwardly depending upon the direction of rotation of the knob 116. At the outermost position of the paddles 92 as illustrated in solid lines in FIG. 5, the air impactive force against the paddles 92 during rotation of the rotor 84 will have the greatest effect because of the resultant increase in force moment. Consequently, the user experiences considerably more resistance to his raising the lever 24 at that position of the paddles 92 than when the same are in their innermost positions as illustrated in dotted lines in FIG. 5. Likewise, the effect of the weight of the paddles 92 insofar as resistance is concerned is greatest when they are at their greatest radial distance from the shaft 78.

It is to be noted that the preferred embodiment herein illustrated utilizes air as a fluid medium within which the rotor 84 rotates to provide the drag against the paddles 92. It is, of course, within the concepts of the present invention, however, to use other types of fluid mediums of gas or liquid variety as may be desirable.

Alternative Embodiment

Figure 6:
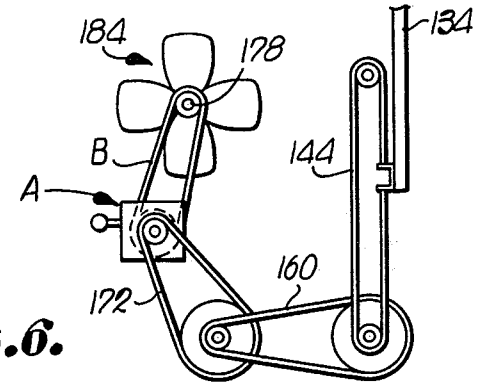
FIG. 6 is a schematic illustration of an alternative embodiment of the apparatus in which speed ratios may be adjusted to in turn adjust the amount of resistance generated by the rotor at a given speed of input stroke by the user.

FIG. 6 illustrates an alternative apparatus from that illustrated in FIGS. 1–5, although the spinning rotor concept still remains. In this regard, the plunger rod 134 drives a chain 144, which in turn drives a chain 160, which in turn drives another chain 172. The chain 172 ultimately drives a rotor 184, but not before the output of chain 172 passes through a speed ratio control A. An endless output element B from the speed control A supplies driving power to the shaft 178 upon which the rotor 184 is mounted. It is, of course, to be understood that the speed ratio control A may take any one of a number of different forms, the simplest of which may be a simple bicycle-type transmission. Another type may, for example, include variable diameter sheaves. In any event, the principle in any selected form of the control A is that the speed of the input chain 172 may be adjusted relative to the speed of the output element B and thus also the speed of rotation of the rotor 84, to the end that the resistance generated by the rotor 184 at any given speed of exercising stroke of the plunger 134 can be adjusted by appropriate manipulation of the control A.

I claim:

1. Exercise apparatus including:

a rotor;

means supporting said rotor for rotation thereof about a certain axis;

manually operable drive means coupled with said rotor for effecting said rotation, said rotor being capable during said rotation of creating resistance to the manual efforts of a user to operate said drive means, said rotor including fluid-drag means associated therewith for creating said resistance through interaction with a fluid medium during said rotation.

said drag means being selectively shiftable radially inwardly and outwardly with respect to the axis of rotation of the rotor for adjustment of the radial distance between said axis and the point of application of said resistance; and mechanism for effecting said shifting adjustment of said drag means and for releasably retaining the same in a selected radial position.

2. Exercise apparatus as claimed in claim 1, wherein said drive means includes shiftable means movable by the user and a one-way clutch drivingly coupling said shiftable means with said rotor in only one direction of movement of said shiftable means.

3. Exercise apparatus as claimed in claim 1, wherein said fluid medium comprises ambient air.

4. Exercise apparatus as claimed in claim 1, wherein said drag means includes a pair of diametrically oppositely disposed plates having the planar surfaces thereof disposed transversely of the plane of rotation of the rotor.

5. Exercise apparatus as claimed in claim 1, wherein said mechanism includes a carriage for said drag means, means defining a radially extending track for said carriage, and a control coupled with said carriage for adjustably shifting the latter radially inwardly and outwardly along said track.

6. Exercise apparatus including:

a rotor;

means supporting said rotor for rotation thereof about a certain axis;

manually operable drive means coupled with said rotor for effecting said rotation, said rotor being capable during said rotation of creating resistance to the manual efforts of a user to operate said drive means, said rotor including fluid-drag means associated therewith for creating said resistance through interaction with a fluid medium during said rotation; and mechanism adapting said drag means for selective positioning and retention thereof at any one of a number of radially outwardly disposed locations independently of said rotation of the rotor, said mechanism including a carriage for said drag means, means defining a radially extending track for said carriage, and a control coupled with said carriage for adjustably shifting the latter radially inwardly and outwardly along said track, said rotor being fixed to a shaft, said control including a tube receiving said shaft and normally rotatable therewith, means operably coupling the tube with said carriage, and means releasably retaining said tube against rotation relative to said shaft whereby, when said retaining means is released, said tube may be rotated relative to said shaft to effect said shifting of the carriage.

7. Exercise apparatus as claimed in claim 6, wherein said means operably coupling the tube with the carriage includes a driving member secured to said tube for rotation therewith and a flexible element drivingly engaged with said member and connected to said carriage.

8. Exercise apparatus including;

a rotor;

means supporting said rotor for rotation thereof about a certain axis;

manually operable drive means coupled with said rotor for effecting said rotation, said rotor being capable during said rotation of creating resistance to the manual efforts of a user to operate said drive means, said rotor including weight means associated therewith and positioned radially outwardly of said axis, said weight means including a pair of diametrically oppositely disposed weights, said mechanism including a carriage for each of said weights, means defining a radially extending track for each of said carriages, and a control coupled with said carriages for adjustably shifting the same radially inwardly and outwardly along said tracks, said rotor being fixed to a shaft, said control including a tube receiving said shaft and normally rotatable therewith, means operably coupling the tube with said carriages, and means releasably retaining said tube against rotation relative to said shaft whereby, when said retaining means is released, said tube may be rotated relative to said shaft to effect said shifting of the carriages.

9. Exercise apparatus as claimed in claim 8, wherein said means operably coupling the tube with the carriages includes a driving member secured to said tube for rotation therewith and an endless flexible element drivingly engaging said member and connected to said carriages.

10. Exercise apparatus including:

a rotor;

means supporting said rotor for rotation thereof about a certain axis;

manually operable drive means coupled with said rotor for effecting said rotation, said rotor being capable during said rotation of creating resistance to the manual efforts of a user to operate said drive means, said rotor including weight means associated therewith and positioned radially outwardly of said axis, said weight means being selectively shiftable radially inwardly and outwardly with respect to said axis for adjustment of the radial distance between said axis and the weight means; and mechanism for effecting said shifting adjustment of said weight means and for releasably retaining the same in a selected radial position against said shifting during rotation of the rotor.

11. Exercise apparatus as claimed in claim 10, wherein said drive means include shiftable means movable by the user and a one-way clutch drivingly coupling said shiftable means with said rotor in only one direction of movement of said shiftable means.

12. Exercise apparatus as claimed in claim 10, wherein said weight means includes a pair of diametrically oppositely disposed weights, said mechanism including a carriage for each of said weights, means defining a radially extending track for each of said carriages, and a control coupled with said carriages for adjustably shifting the same radially inwardly and outwardly along said tracks.

13. Exercise apparatus as claimed in claim 10, wherein said weight means includes fluid-drag means associated therewith for augmenting the resistance of said weight means by virtue of interacting with a fluid medium during said rotation.

14. Exercise apparatus as claimed in claim 13, wherein said fluid medium comprises ambient air.

* * * * *